US010696053B2

(12) United States Patent
Ogasahara

(10) Patent No.: US 10,696,053 B2
(45) Date of Patent: Jun. 30, 2020

(54) INK JET RECORDING APPARATUS

(71) Applicant: KYOCERA Document Solutions Inc., Osaka (JP)

(72) Inventor: Okito Ogasahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/459,195

(22) Filed: Jul. 1, 2019

(65) Prior Publication Data

US 2020/0016899 A1 Jan. 16, 2020

(30) Foreign Application Priority Data

Jul. 11, 2018 (JP) ..... 2018-131694

(51) Int. Cl.
*B41J 2/165* (2006.01)

(52) U.S. Cl.
CPC ..... *B41J 2/16538* (2013.01); *B41J 2/16523* (2013.01); *B41J 2/16585* (2013.01)

(58) Field of Classification Search
CPC . B41J 2/16538; B41J 2/16523; B41J 2/16585
USPC ..... 347/20, 22, 33
See application file for complete search history.

(56) References Cited

U.S. PATENT DOCUMENTS 9,427,971 B2 * 8/2016 Kobayashi ..... B41J 2/16508
9,463,631 B2 * 10/2016 Tanda ..... B41J 2/16544
10,011,114 B2 * 7/2018 Muto ..... B41J 2/16544

FOREIGN PATENT DOCUMENTS

JP 2017-196794 A 11/2017

* cited by examiner

*Primary Examiner* — An H Do
(74) *Attorney, Agent, or Firm* — Stein IP, LLC

(57) ABSTRACT

An ink jet recording apparatus includes a line head, a purging mechanism, a wiper blade, a blade moving mechanism, a waste liquid passage forming portion, and a maintenance control portion. The maintenance control portion performs a first maintenance process of allowing a cleaning liquid ejection nozzle to eject cleaning liquid without allowing ink ejection nozzles to eject ink, and then allowing the wiper blade to move from a first end edge to a second end edge on a liquid ejection surface, and a second maintenance process of allowing the ink ejection nozzles to eject ink while allowing the cleaning liquid ejection nozzle to eject the cleaning liquid, and then allowing the wiper blade to move from the first end edge to the second end edge on the liquid ejection surface, after the first maintenance process.

8 Claims, 19 Drawing Sheets

INK JET RECORDING APPARATUS

INCORPORATION BY REFERENCE

This application is based upon and claims the benefit of priority from the corresponding Japanese Patent Application No. 2018-131694 filed Jul. 11, 2018, the entire contents of which are hereby incorporated by reference.

BACKGROUND

The present disclosure relates to an ink jet recording apparatus that forms an image by ejecting ink onto a sheet.

As an image forming apparatus such as a printer, a copier, or a facsimile, there is known an ink jet recording apparatus that forms an image by ejecting ink onto a sheet. This ink jet recording apparatus is equipped with a line head including a plurality of ink ejection nozzles to eject ink arranged in a predetermined direction.

In the ink jet recording apparatus, if there is a bubble, a foreign object, or thickened ink inside the ink ejection nozzle, ink cannot be ejected normally. Therefore, the ink jet recording apparatus performs a maintenance process of the line head while the image forming process on a sheet is not performed. The maintenance process of the line head includes a purging process for forcibly ejecting pressured ink from the ink ejection nozzle, and a wiping process for wiping off ink droplets attached to an ink ejection surface of the line head with a wiper blade after the purging process.

SUMMARY

An ink jet recording apparatus according to one aspect of the present disclosure includes a line head, a purging mechanism, a wiper blade, a blade moving mechanism, a waste liquid passage forming portion, and a maintenance control portion. The line head includes a plurality of ink ejection nozzles to eject ink arranged in a predetermined direction, and a cleaning liquid ejection nozzle to eject cleaning liquid disposed at one side in the predetermined direction. The line head has a liquid ejection surface including an ink ejection area formed by nozzle holes of the ink ejection nozzles and a cleaning liquid ejection area formed by a nozzle hole of the cleaning liquid ejection nozzle. The purging mechanism performs an ink purging operation to eject pressured ink from the ink ejection nozzles and a cleaning liquid purging operation to eject pressured cleaning liquid from the cleaning liquid ejection nozzle. The wiper blade moves from a first end edge on the cleaning liquid ejection area side to a second end edge on the ink ejection area side on the liquid ejection surface while contacting with the liquid ejection surface so as to wipe off droplets attached to the liquid ejection surface. The blade moving mechanism allows the wiper blade to move. The waste liquid passage forming portion forms a waste liquid passage allowing liquid wiped off by the wiper blade from the liquid ejection surface to flow. The maintenance control portion controls the purging mechanism and the blade moving mechanism to perform a maintenance process of the line head. The maintenance control portion performs a first maintenance process of allowing the cleaning liquid ejection nozzle to eject the cleaning liquid without allowing the ink ejection nozzles to eject ink, and then allowing the wiper blade to move from the first end edge to the second end edge on the liquid ejection surface, and a second maintenance process of allowing the ink ejection nozzles to eject ink while allowing the cleaning liquid ejection nozzle to eject the cleaning liquid, and then allowing the wiper blade to move from the first end edge to the second end edge on the liquid ejection surface, after the first maintenance process.

Other objects of the present disclosure and specific advantages obtained by the present disclosure will become more apparent from the description of the embodiment given below.

DETAILED DESCRIPTION

Hereinafter, an ink jet recording apparatus according to one embodiment of the present disclosure is described with reference to the drawings. Note that in the following description, XYZ orthogonal coordinate axes are used for describing a directional relationship. The X direction corresponds to a front and rear direction (+X corresponds to rear while −X corresponds to front), the Y direction corresponds to a left and right direction (+Y corresponds to left while −Y corresponds to right), and the Z direction corresponds to an up and down direction (+Z corresponds to up while −Z corresponds to down). Further, in the following description, the term "sheet" means a copy paper sheet, a coat paper sheet, an OHP sheet, a thick paper sheet, a postcard, a tracing paper sheet, or other material sheet on which an image forming process is performed, or a material sheet on which an arbitrary process other than the image forming process is performed.

[Overall Structure of Ink Jet Recording Apparatus]

Figure 1:
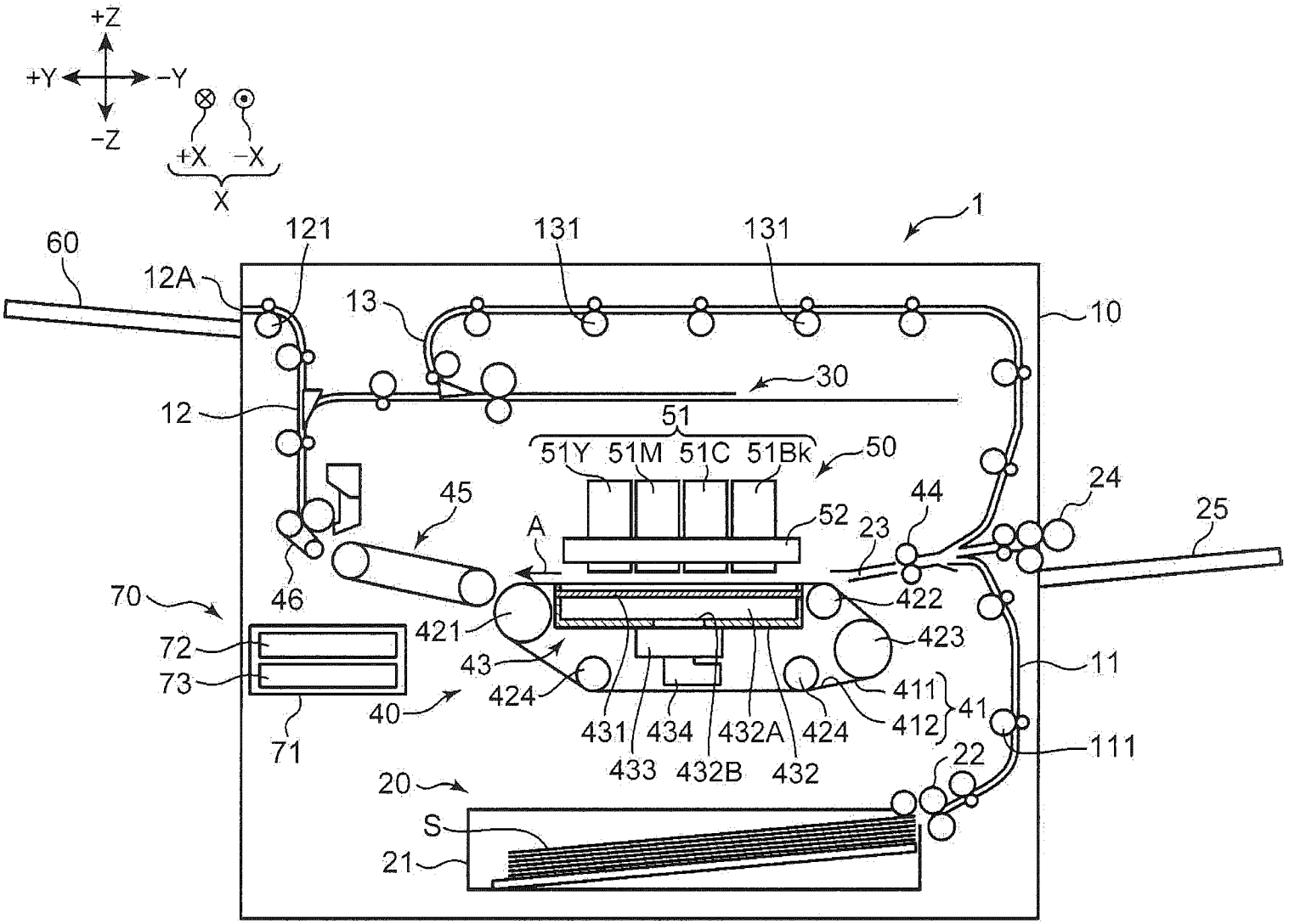
FIG. 1 is a diagram schematically illustrating an ink jet recording apparatus according to one embodiment of the present disclosure.

FIG. 1 is a diagram schematically illustrating an ink jet recording apparatus 1 according to one embodiment of the present disclosure. The ink jet recording apparatus 1 illustrated in FIG. 1 is an image forming apparatus that ejects ink droplets to form (record) an image on a sheet S. The ink jet recording apparatus 1 includes an apparatus main body 10, a sheet feeding unit 20, a sheet reversing unit 30, a sheet conveyor unit 40, an image forming portion 50, a sheet discharging unit 60, and a maintenance unit 70.

The apparatus main body 10 is a box-shaped casing that houses various devices for forming an image on the sheet S. This apparatus main body 10 is provided with a first conveying path 11, a second conveying path 12, and a third conveying path 13, which form a passage for conveying the sheet S.

The sheet feeding unit 20 feeds the sheet S to the first conveying path 11. The sheet feeding unit 20 includes a sheet feed cassette 21 and a pickup roller 22. The sheet feed cassette 21 is detachable from and attachable to the apparatus main body 10, and the sheets S are stored in the sheet feed cassette 21. The pickup roller 22 is disposed at an end portion of the sheet feed cassette 21 on the −Y side and the +Z side. The pickup roller 22 picks up a top sheet S from the sheets stored in the sheet feed cassette 21 one by one and sends out the sheet S to the first conveying path 11.

The sheet S fed to the first conveying path 11 is conveyed to a registration roller pair 44 of the sheet conveyor unit 40 disposed at a downstream end of the first conveying path 11 by a first conveying roller pair 111 disposed in the first conveying path 11. In addition, a sheet feeding tray 25 is disposed on the side surface of the apparatus main body 10 on the −Y side, and the sheet S can be set on the upper surface of the sheet feeding tray 25. The sheet S set on the sheet feeding tray 25 is sent out to the registration roller pair 44 by a sheet feed roller 24.

The registration roller pair 44 is a conveying roller pair disposed at an upstream end in the sheet conveyor unit 40. The registration roller pair 44 performs skew correction of the sheet S and sends out the sheet S to a conveyor belt 41 via a sheet input guide portion 23 in synchronization with timing of the image forming process by the image forming portion 50. In this way, the registration roller pair 44 conveys the sheet S to the image forming portion 50.

The sheet input guide portion 23 guides the sheet S sent out from the registration roller pair 44 toward an outer circumference surface 411 of the conveyor belt 41 in the sheet conveyor unit 40.

When a front end of the sheet S guided by the sheet input guide portion 23 contacts an outer circumference surface 411 of the conveyor belt 41, the sheet S is conveyed in a sheet conveying direction A while being held on the outer circumference surface 411 by drive of the conveyor belt 41. Note that the sheet conveying direction A is a direction from the −Y side to the +Y side in the Y direction.

The sheet conveyor unit 40 is disposed to face a line head 51 on the −Z side of the image forming portion 50. The sheet conveyor unit 40 conveys the sheet S guided and introduced by the sheet input guide portion 23 in the sheet conveying direction A so that the sheet S passes on the −Z side of the image forming portion 50. The sheet conveyor unit 40 includes the conveyor belt 41 and a suction unit 43 in addition to the registration roller pair 44.

The conveyor belt 41 is an endless belt that has a width in the X direction and extends in the Y direction. The conveyor belt 41 is disposed to face the image forming portion 50 and conveys the sheet S on the outer circumference surface 411 in the sheet conveying direction A. More specifically, the conveyor belt 41 holds the sheet S on the outer circumference surface 411 and conveys the same in the sheet conveying direction A within a predetermined convey area facing the line head 51 of the image forming portion 50.

The conveyor belt 41 is stretched around a first roller 421, a second roller 422, a third roller 423, and a pair of fourth rollers 424. Inside the stretched conveyor belt 41, the suction unit 43 is disposed to face an inner circumference surface 412 of the conveyor belt 41. The first roller 421 is a drive roller extending in the X direction that is the width direction of the conveyor belt 41, and is disposed on the downstream side of the suction unit 43 in the sheet conveying direction A. The first roller 421 is driven to rotate by a drive motor (not shown), so as to turn the conveyor belt 41 in a predetermined turning direction. When the conveyor belt 41 is turned, the sheet S held on the outer circumference surface 411 thereof is conveyed in the sheet conveying direction A.

The second roller 422 is a belt speed detection roller extending in the X direction and is disposed on the upstream side of the suction unit 43 in the sheet conveying direction A. The second roller 422 is disposed so as to maintain flatness of an area of the outer circumference surface 411 of the conveyor belt 41 facing the line head 51 and an area of the inner circumference surface 412 of the conveyor belt 41 facing the suction unit 43, in cooperation with the first roller 421. Here in the outer circumference surface 411 of the conveyor belt 41, the area facing the line head 51 between the first roller 421 and the second roller 422 is the predetermined convey area for holding and conveying the sheet S as described above. The second roller 422 rotates following the turning of the conveyor belt 41. A pulse plate (not shown) is attached to the second roller 422, and this pulse plate rotates integrally with the second roller 422. By measuring the rotation speed of the pulse plate, the rotation speed of the conveyor belt 41 is detected.

The third roller 423 is a tension roller extending in the X direction and gives tension to the conveyor belt 41 so that the conveyor belt 41 does not sag. The third roller 423 rotates following the turning of the conveyor belt 41. Each of the pair of fourth rollers 424 is a guide roller extending in the X direction and guides the conveyor belt 41 so that the conveyor belt 41 passes on the −Z side of the suction unit 43. The pair of fourth rollers 424 rotate following the turning of the conveyor belt 41.

In addition, the conveyor belt 41 has a plurality of suction holes penetrating the same in the thickness direction from the outer circumference surface 411 to the inner circumference surface 412 (not shown).

The suction unit 43 is disposed to face the image forming portion 50 via the conveyor belt 41. More specifically, the suction unit 43 is disposed to face the inner circumference surface 412 inside the conveyor belt 41 stretched around the first roller 421, the second roller 422, the third roller 423, and the pair of fourth rollers 424. The suction unit 43 generates negative pressure between the conveyor belt 41 and the sheet S held on the outer circumference surface 411 of the conveyor belt 41, so that the sheet S intimately contacts with the outer circumference surface 411 of the conveyor belt 41. The suction unit 43 includes a belt guide member 431, a suction casing 432, a suction device 433, and an exhaust duct 434.

The belt guide member 431 is disposed to face an area of the inner circumference surface 412 of the conveyor belt 41 between the first roller 421 and the second roller 422, and is a plate member having a width that is substantially the same as a size of the conveyor belt 41 in the width direction (X direction). The belt guide member 431 constitutes an upper surface portion of the suction casing 432 and has substantially the same shape as the suction casing 432 viewed from the +Z side. The belt guide member 431 guides the turning movement of the conveyor belt 41 between the first roller 421 and the second roller 422 when the first roller 421 rotates.

In addition, the belt guide member 431 has a plurality of grooves (not shown) formed on a belt guide surface facing the inner circumference surface 412 of the conveyor belt 41. The grooves are formed corresponding to the suction holes (not shown) of the conveyor belt 41. Further, the belt guide member 431 has through holes (not shown) formed corresponding to the grooves. The through hole is formed in each groove to penetrate the belt guide member 431 in the thickness direction, and it communicates to the suction hole of the conveyor belt 41 through each groove.

The suction unit 43 provided with the belt guide member 431 having the structure described above sucks air through the grooves and the through holes of the belt guide member 431 and the suction holes of the conveyor belt 41 from the space on the +Z side of the conveyor belt 41, and thereby generates a suction force. This suction force causes an air flow (suction wind) directed toward the suction unit 43 in a space above the conveyor belt 41. When the sheet S is guided by the sheet input guide portion 23 onto the conveyor belt 41 so as to cover a part of the outer circumference surface 411 of the conveyor belt 41, the suction force (negative pressure) is applied to the sheet S so that the sheet S intimately contacts with the outer circumference surface 411 of the conveyor belt 41.

In the suction unit 43, the suction casing 432 constitutes a support frame that supports the belt guide member 431 from below, which constitutes the upper surface portion of the suction casing 432. The suction casing 432 is a box-shaped casing having an opening on the +Z side, and it is disposed on the −Z side of the conveyor belt 41 so that the opening on the +Z side is covered with the belt guide member 431. The suction casing 432 defines a suction space 432A together with the belt guide member 431 constituting the upper surface portion thereof. In other words, a space enclosed by the suction casing 432 and the belt guide member 431 is the suction space 432A. This suction space 432A communicates to the suction holes of the conveyor belt 41 through the grooves and the through holes of the belt guide member 431.

The bottom wall of the suction casing 432 is provided with an opening 432B, and the suction device 433 is disposed corresponding to the opening 432B. The suction device 433 includes a fan (not shown). This suction device 433 is connected to the exhaust duct 434. This exhaust duct 434 is connected to an exhaust port (not shown) provided to the apparatus main body 10.

The image forming portion 50 is disposed on the +Z side of the sheet conveyor unit 40. Specifically, the image forming portion 50 is disposed to face the outer circumference surface 411 of the conveyor belt 41 on the +Z side of the sheet conveyor unit 40. The image forming portion 50 performs the image forming process on the sheet S that is conveyed in the sheet conveying direction A while being held on the outer circumference surface 411 of the conveyor belt 41, and thereby forms an image. In this embodiment, the image forming portion 50 is an ink jet type concerning the image forming method, and it ejects ink droplets so as to form an image on the sheet S.

Figure 2:
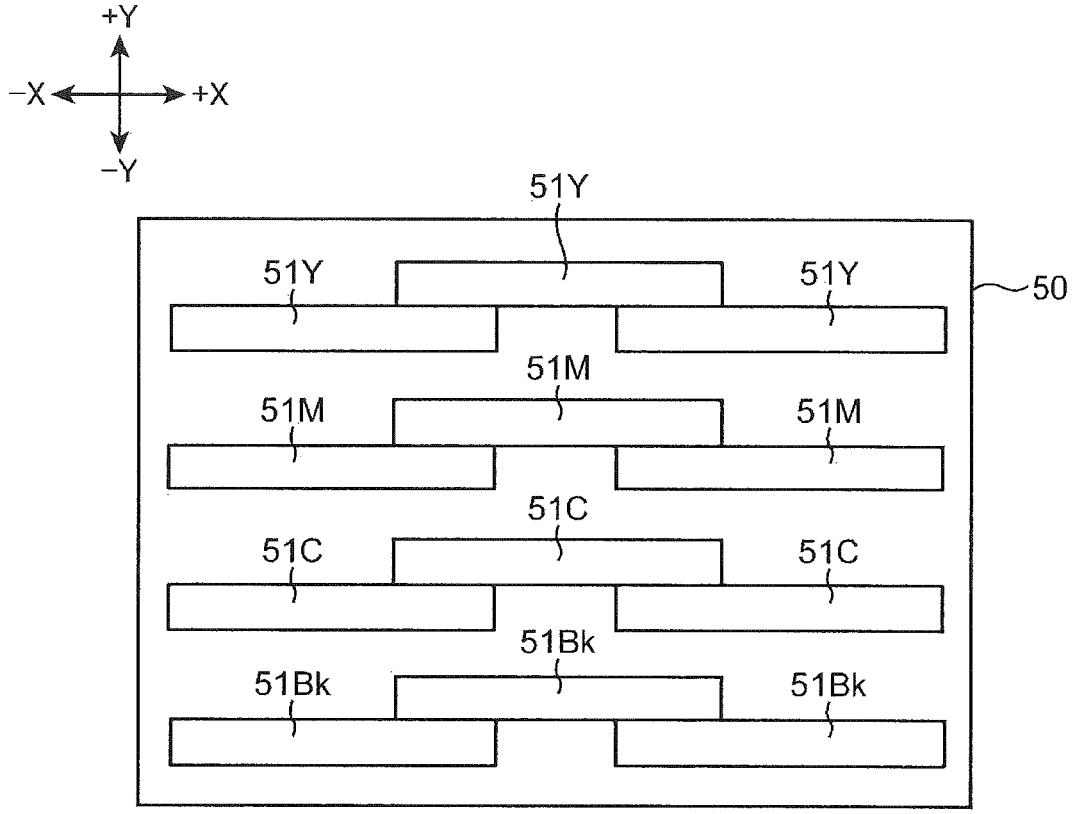
FIG. 2 is a diagram illustrating a structure of an image forming portion provided to the ink jet recording apparatus.

The image forming portion 50 includes line heads 51Bk, 51C, 51M, and 51Y held by a head housing 52. The line head 51Bk ejects black color ink droplets, the line head 51C ejects cyan color ink droplets, the line head 51M ejects magenta color ink droplets, and the line head 51Y ejects yellow color ink droplets. The line heads 51Bk, 51C, 51M, and 51Y are arranged from the upstream side to the downstream side in the sheet conveying direction A. In this embodiment, as illustrated in FIG. 2, the image forming portion 50 is constituted of the line heads 51Bk, 51C, 51M, and 51Y, each of which includes three heads arranged in a staggered manner in the X direction perpendicular to the sheet conveying direction A. The line heads 51Bk, 51C, 51M, and 51Y have the same structure except that colors of ink droplets to be ejected are different, and they may be collectively referred to as the line head 51.

The line head 51 ejects ink droplets onto the sheet S conveyed in the sheet conveying direction A while being held on the outer circumference surface 411 of the conveyor belt 41, so as to form an image on the sheet S. Specifically, the line head 51 ejects ink droplets to the sheet S that is conveyed by the conveyor belt 41 and passes a position facing the line head 51. In this way, an image is formed on the sheet S. Details of the line head 51 will be described later.

The sheet S with the image formed by ink droplets ejected from the line head 51 is conveyed by the conveyor belt 41 and is sent out to a conveying unit 45 disposed on the downstream side of the conveyor belt 41 in the sheet conveying direction A. The conveying unit 45 further conveys the sheet S received from the sheet conveyor unit 40 to the downstream side in the sheet conveying direction A. A decurler unit 46 is disposed on the downstream side of the conveying unit 45. The decurler unit 46 corrects curl of the sheet S received from the conveying unit 45 while further conveying the sheet S to the downstream side in the sheet conveying direction A. The sheet S conveyed by the decurler unit 46 is sent out to the second conveying path 12.

The second conveying path 12 extends along the side surface on the +Y side of the apparatus main body 10. The sheet S sent out to the second conveying path 12 is conveyed to a sheet outlet 12A formed on the +Y side of the apparatus main body 10 by a second conveying roller pair 121 disposed in the second conveying path 12, and is discharged from the sheet outlet 12A onto the sheet discharging unit 60.

On the other hand, if the sheet S sent out to the second conveying path 12 is a sheet for duplex printing with an image that is already formed on a first side (front side), the sheet S is sent out to the sheet reversing unit 30. The sheet reversing unit 30 is a branch conveying path, branching on the way of the second conveying path 12, and is a part by which the sheet S is reversed (switched back). The sheet S whose front and back sides are reversed by the sheet reversing unit 30 is sent out to the third conveying path 13. The sheet S sent out to the third conveying path 13 is reversely conveyed by a third conveying roller pair 131 disposed in the third conveying path 13, and the sheet S is resupplied onto the outer circumference surface 411 of the conveyor belt 41 in the state where the front and back sides are reversed, via the registration roller pair 44 and the sheet input guide portion 23. The sheet S, which is supplied onto the outer circumference surface 411 of the conveyor belt 41 in the state where the front and back sides are reversed as described above, is conveyed by the conveyor belt 41 while the image forming portion 50 performs the image forming process on a second side (back side) opposite to the first side. The sheet S after completion of the duplex printing passes through the second conveying path 12 and is discharged onto the sheet discharging unit 60 from the sheet outlet 12A.

Figure 3:
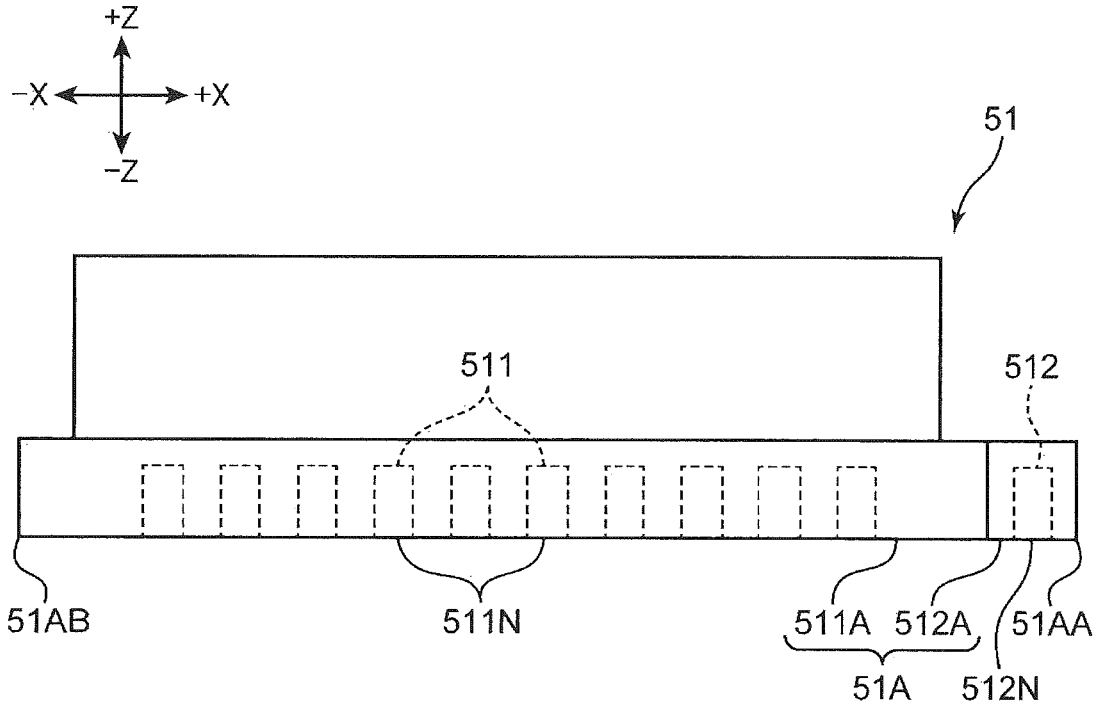
FIG. 3 is a diagram illustrating a structure of a line head provided to the image forming portion.

The line head 51 provided to the image forming portion 50 is described in detail with reference to FIG. 3. The line head 51 is a recording head including a plurality of ink ejection nozzles 511 to eject ink arranged in a predetermined direction (X direction) and a cleaning liquid ejection nozzle 512 to eject cleaning liquid disposed at one side in the arrangement direction of the ink ejection nozzles 511. The line head 51 of this structure has a liquid ejection surface 51A including an ink ejection area 511A constituted of nozzle holes 511N of the ink ejection nozzles 511 and a cleaning liquid ejection area 512A constituted of a nozzle hole 512N of the cleaning liquid ejection nozzle 512.

It is preferred that unlike the ink, the cleaning liquid ejected from the cleaning liquid ejection nozzle 512 be, for example, a solution having components of the ink except for color material, or a solution having components similar to the components of the ink except for color material. It is because mixing of the cleaning liquid into the ink may cause little influence to characteristics of the ink. The cleaning liquid contains solvent and water, for example. Specifically, it is preferred that the cleaning liquid contain ion-exchanged water and alcohol. If the cleaning liquid contains alcohol, permeability of the cleaning liquid can be enhanced. More preferably, the cleaning liquid further contains glycol ether. If the cleaning liquid contains glycol ether, permeability of the cleaning liquid can be enhanced. The cleaning liquid may further include at least one of glycerin and glycol. In this case, vaporization of the cleaning liquid can be suppressed. In addition, at least one of surface active agent, antiseptic agent, and antifungal agent may be added to the cleaning liquid.

When the ink jet recording apparatus 1 performs the image forming process to form an image on the sheet S, the ink ejection nozzles 511 of the line head 51 eject ink. On the other hand, when a maintenance process of the line head 51 is performed while the image forming process on the sheet S is stopped, a purging process is performed in which the ink ejection nozzles 511 eject pressured ink, and the cleaning liquid ejection nozzle 512 ejects pressured cleaning liquid.

The maintenance process of the line head 51 is performed by the maintenance unit 70 illustrated in FIG. 1. The maintenance unit 70 includes a cap unit 72 and a wipe unit 73 mounted in a carriage 71. Details of the structure of this maintenance unit 70 and details of the maintenance process of the line head 51 will be described later.

[Control System of Ink Jet Recording Apparatus]

A control system of the ink jet recording apparatus 1 is described with reference to a block diagram of FIG. 4. The ink jet recording apparatus 1 further includes a purging mechanism 80, a conveyor lifting mechanism 83, a carriage moving mechanism 84, a cap lifting mechanism 85, a wipe lifting mechanism 86, a blade moving mechanism 87, and a control unit 90.

The control unit 90 is constituted of a microcomputer including a storage device such as a read only memory (ROM) storing a control program and a flash memory for temporarily storing data. The control program is read out, and an operation of the ink jet recording apparatus 1 is controlled. The control unit 90 includes an image forming control portion 91, a maintenance control portion 92, and a clock portion 93. The image forming control portion 91 mainly controls the sheet conveying operation of the sheet conveyor unit 40 and the image forming operation of the image forming portion 50, so as to perform the image forming process on the sheet S.

The maintenance control portion 92 controls the purging mechanism 80, the conveyor lifting mechanism 83, the carriage moving mechanism 84, the cap lifting mechanism 85, the wipe lifting mechanism 86, and the blade moving mechanism 87 while the image forming process on the sheet S is stopped, so as to perform the maintenance process of the line head 51. The maintenance process of the line head 51 includes a capping process, a purging process, and a wiping process.

<Capping Process>

Figure 5:
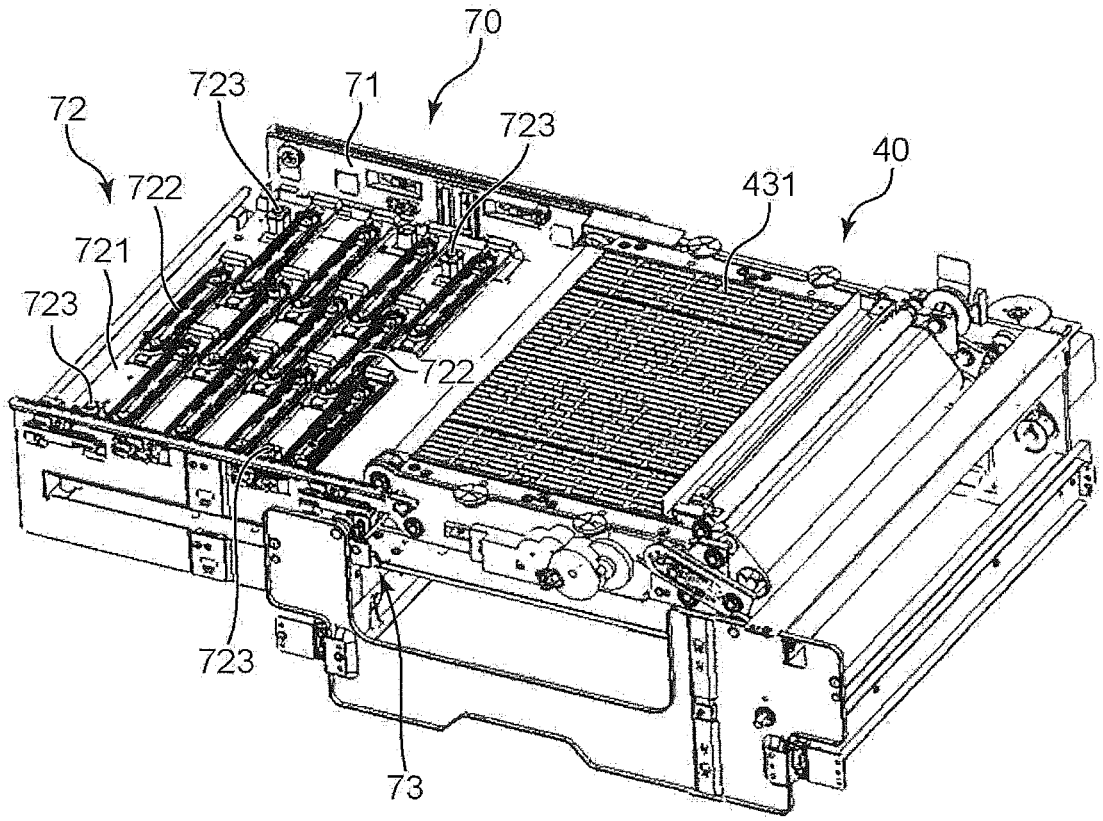
FIG. 5 is a perspective view illustrating a state in which a maintenance unit of the ink jet recording apparatus is in a retract position.
Figure 6:
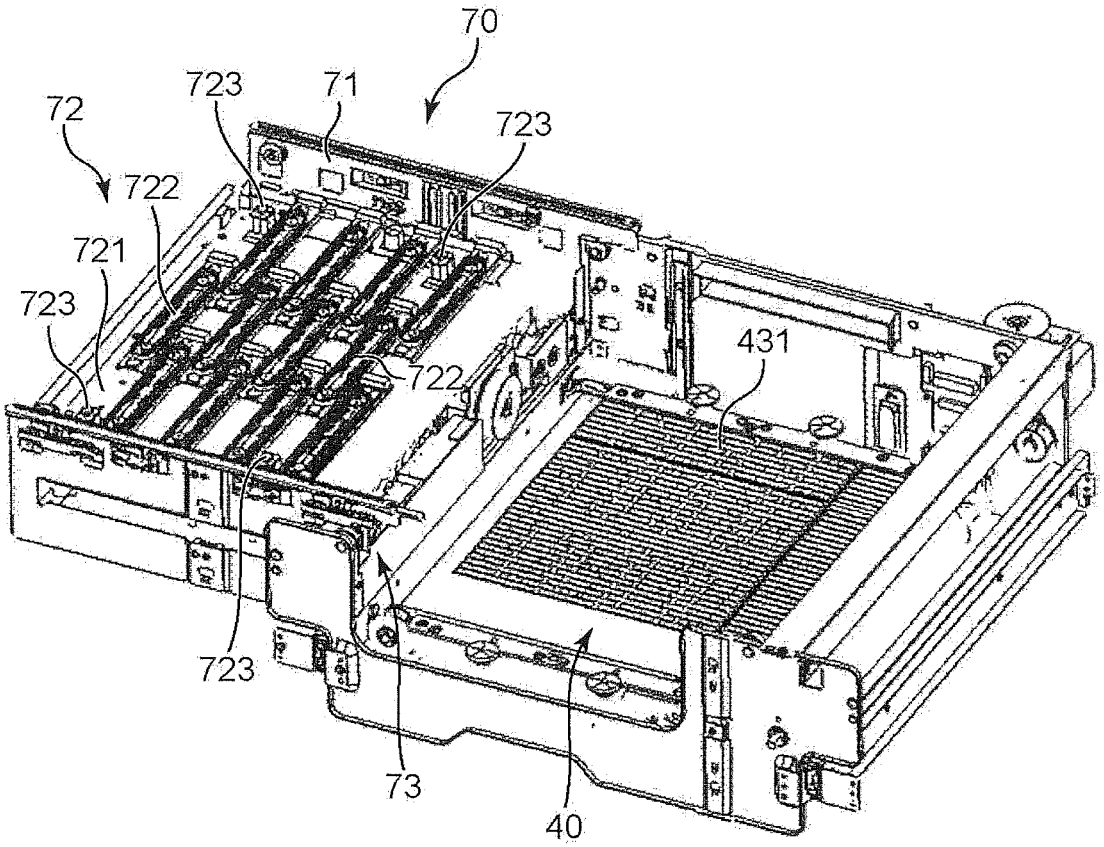
FIG. 6 is a perspective view illustrating a state in which a sheet conveyor unit of the ink jet recording apparatus is moved down.
Figure 7:
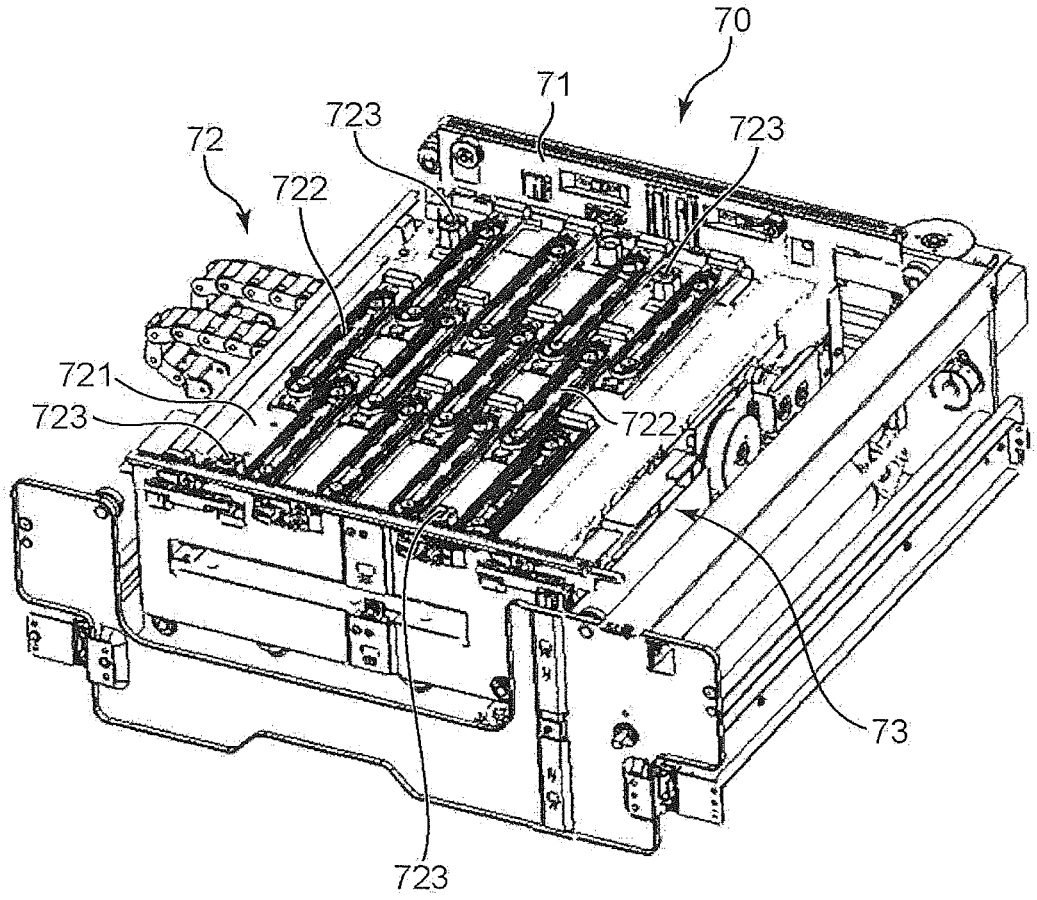
FIG. 7 is a perspective view illustrating a state in which the maintenance unit is in a maintenance position.
Figure 8:
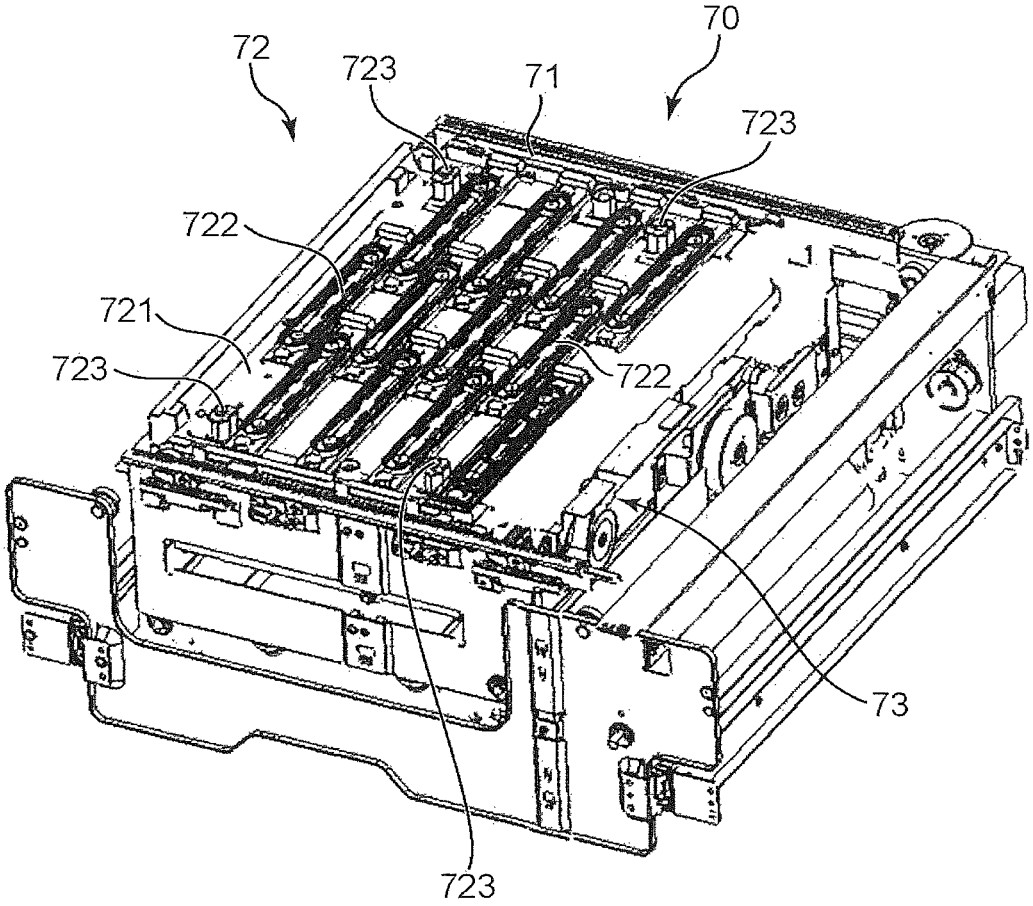
FIG. 8 is a perspective view illustrating a state in which a cap unit of the maintenance unit is moved up.

The capping process is a process of capping the line head 51. The maintenance control portion 92 mainly controls the conveyor lifting mechanism 83, the carriage moving mechanism 84, and the cap lifting mechanism 85, so as to perform the capping process. This capping process is described with reference to FIGS. 5 to 8. The carriage moving mechanism 84 moves the carriage 71 in the maintenance unit 70 so as to move the cap unit 72 between a retract position (see FIG. 5) retracting from the image forming portion 50 in the horizontal direction (Y direction) and a maintenance position (see FIG. 7) vertically below the image forming portion 50. Note that before the cap unit 72 is moved from the retract position to the maintenance position, the conveyor lifting mechanism 83 moves the sheet conveyor unit 40 downward from position just below the image forming portion 50 (see FIG. 6).

The cap unit 72 includes a cap tray 721 made of metal sheet, twelve concave cap portions 722 disposed on the upper surface of the cap tray 721, and four positioning protrusions 723. The cap portions 722 are disposed on the cap tray 721 corresponding respectively to the line heads 51 disposed in a staggered manner for each of Y, M, C, and Bk colors. In the maintenance position illustrated in FIG. 7, the cap unit 72 is moved upward by the cap lifting mechanism 85 (see FIG. 8), and thereby the cap portions 722 cap the liquid ejection surfaces 51A of the line heads 51. When the cap lifting mechanism 85 moves the cap unit 72 upward, the positioning protrusion 723 contacts with the head housing 52 that holds the line heads 51, and thereby the contact state between the cap portion 722 and the liquid ejection surface 51A is maintained constantly.

<Purging Process and Wiping Process>

The purging process is a process of forcibly ejecting pressured ink from the ink ejection nozzle 511 in order to remove bubbles, foreign objects, thickened ink, or the like in the ink ejection nozzle 511 of the line head 51. The wiping process is a process of wiping off ink droplets attached to the liquid ejection surface 51A of the line head 51 after the purging process. The purging process and the wiping process are described with reference to FIGS. 5, 6, and 9 to 11. The carriage moving mechanism 84 moves the carriage 71 in the maintenance unit 70, and thereby moves the wipe unit 73 between the retract position (see FIG. 5) retracting from the image forming portion 50 in the horizontal direction and the maintenance position (see FIG. 9) vertically below the image forming portion 50. Note that when the wipe unit 73 is moved from the retract position to the maintenance position, the cap unit 72 supported above the wipe unit 73 in the carriage 71 is maintained at the retract position. In addition, before the wipe unit 73 is moved from the retract position to the maintenance position, the conveyor lifting mechanism 83 moves the sheet conveyor unit 40 downward from the position just below the image forming portion 50 (see FIG. 6).

Figure 9:
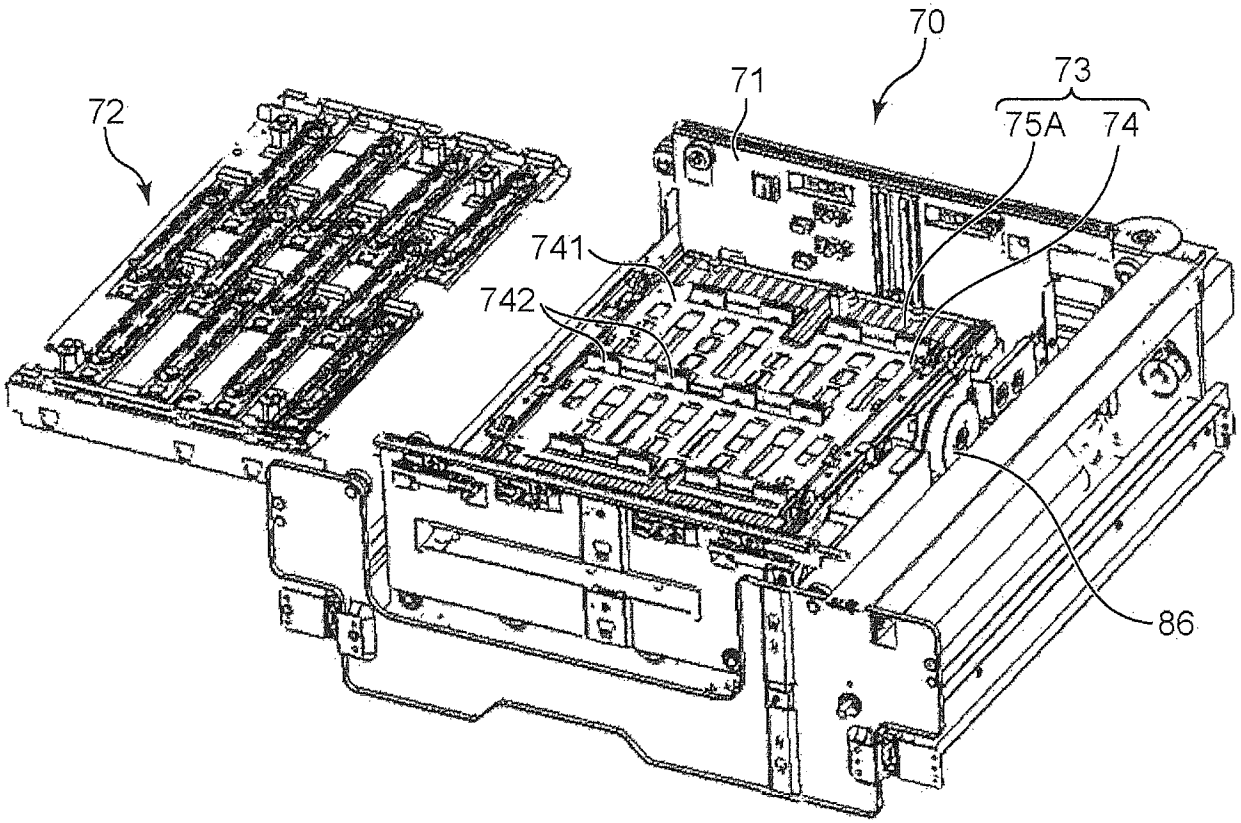
FIG. 9 is a perspective view illustrating a state in which the cap unit is in a retract position while a wipe unit is in a maintenance position in the maintenance unit.
Figure 10:
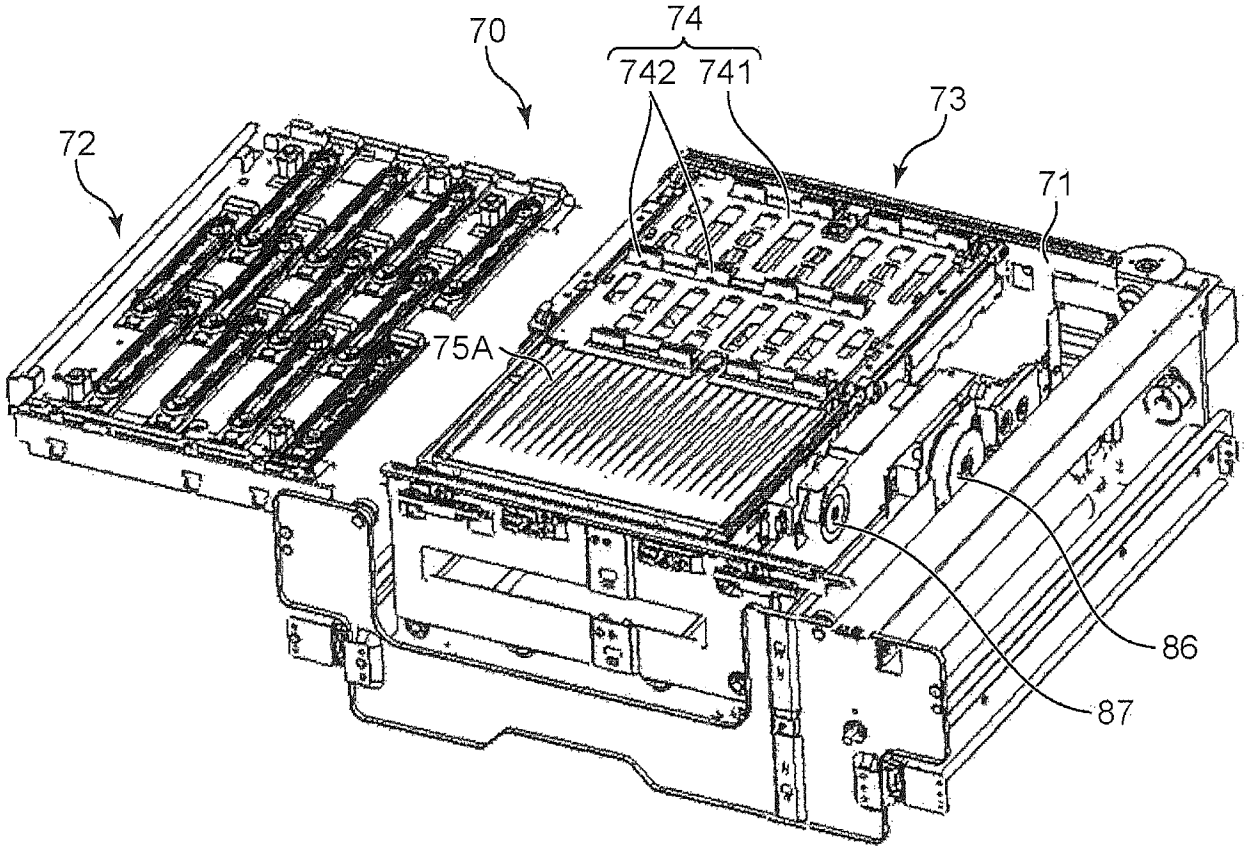
FIG. 10 is a perspective view illustrating a state in which the wipe unit is moved up.
Figure 11:
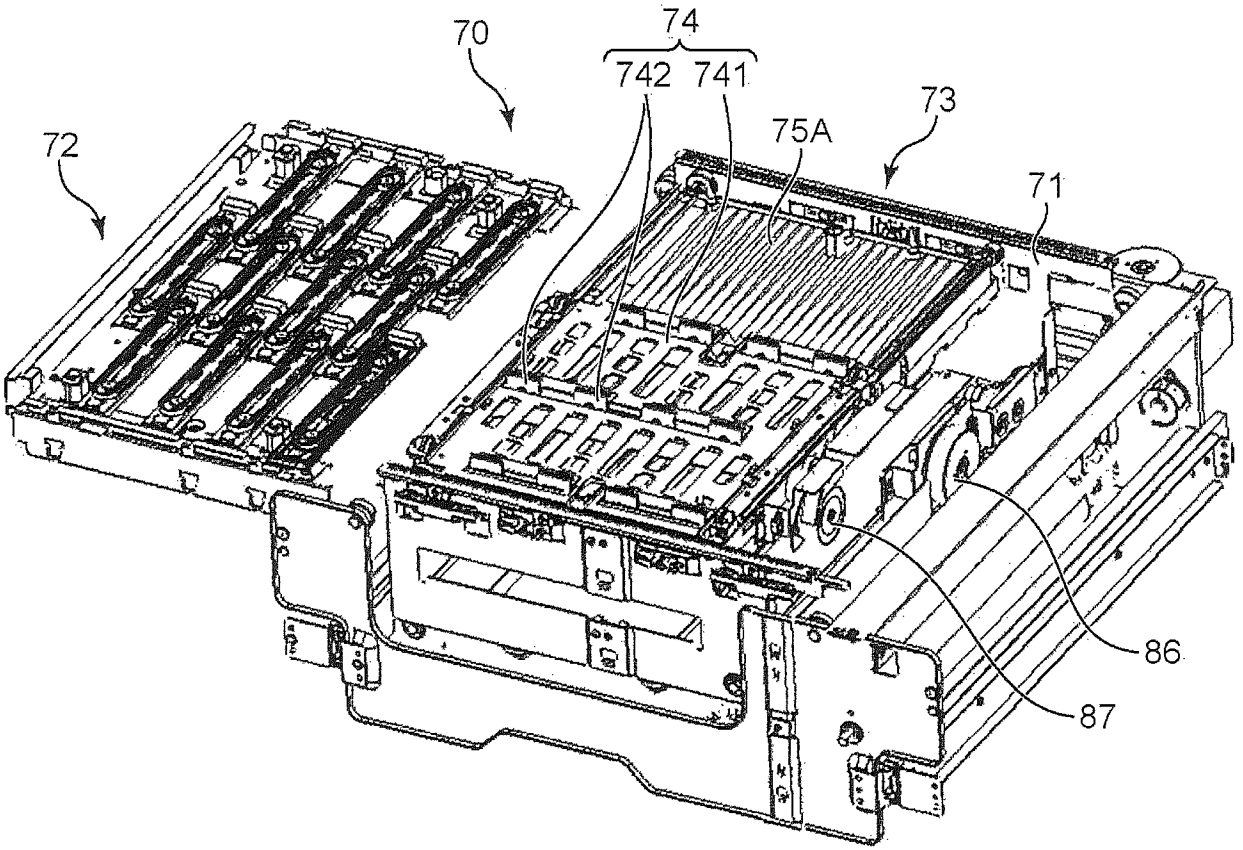
FIG. 11 is a perspective view illustrating a state in which a blade unit of the wipe unit has performed a wiping operation.

In the state where the wipe unit 73 is at the maintenance position illustrated in FIG. 9, the wipe unit 73 is moved upward by the wipe lifting mechanism 86 (see FIG. 10). After that, the maintenance control portion 92 controls the purging mechanism 80 so as to perform the purging process of the line head 51, and controls the blade moving mechanism 87 so as to move a blade unit 74 of the wipe unit 73 (see FIG. 11), and thereby performs the wiping process of the line head 51.

Figure 4:
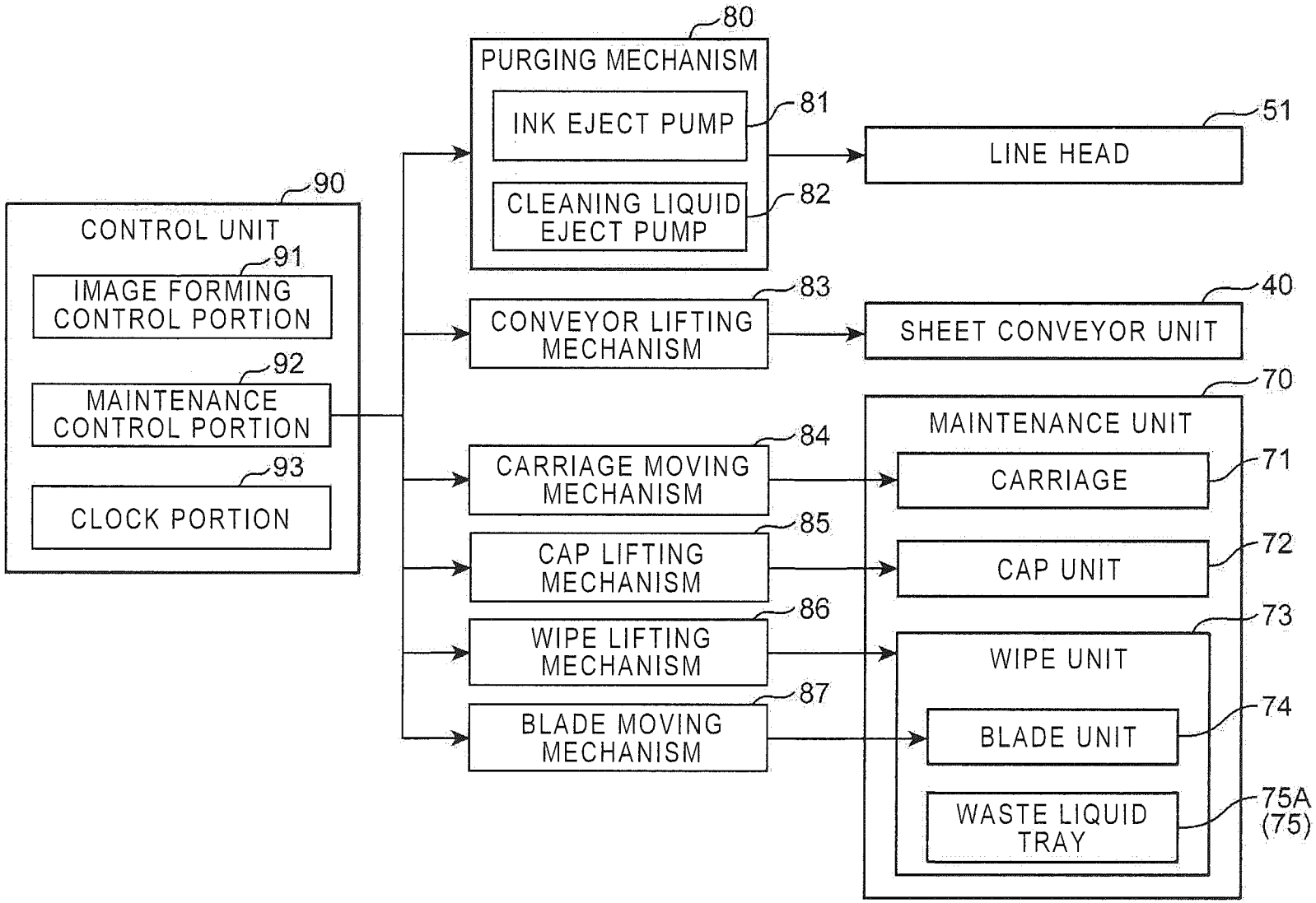
FIG. 4 is a block diagram illustrating a control system of the ink jet recording apparatus.

The purging mechanism 80 includes an ink eject pump 81 and a cleaning liquid eject pump 82 as illustrated in FIG. 4. The purging mechanism 80 activates the ink eject pump 81 so as to perform an ink purging operation of ejecting pressured ink from the ink ejection nozzles 511 of the line head 51. In addition, the purging mechanism 80 activates the cleaning liquid eject pump 82 so as to perform a cleaning liquid purging operation of ejecting pressured cleaning liquid from the cleaning liquid ejection nozzle 512 of the line head 51.

The wipe unit 73 includes the blade unit 74 and a waste liquid tray 75A. The blade unit 74 includes a wiper carriage 741 and wiper blades 742. The wiper carriage 741 holds the wiper blades 742 and is disposed in a movable manner in the X direction while holding the wiper blades 742. The wiper carriage 741 is moved in the X direction by the blade moving mechanism 87, so that the wiper blade 742 moves along the line head 51 in the state where the wipe unit 73 is at the position vertically above the maintenance position (see FIG. 10) that is the position just below the line head 51 of the image forming portion 50. In other words, the blade moving mechanism 87 moves the wiper carriage 741 of the blade unit 74 in the X direction, and thereby moves the wiper blade 742 together with the wiper carriage 741 in the X direction along the line head 51.

The wiper blade 742 is disposed corresponding to each of the line heads 51 disposed in a staggered manner for each of Y, M, C, and Bk colors, and it performs the wiping operation of wiping off droplets attached to the liquid ejection surface 51A of the line head 51 after the purging process including the ink purging operation and the cleaning liquid purging operation by the purging mechanism 80. The wiper blade 742 is an elastic member made of rubber such as EPDM, for example. By the moving operation of the wiper carriage 741 by the blade moving mechanism 87, the wiper blade 742 moves from a first end edge 51AA on the cleaning liquid ejection area 512A side to a second end edge 51AB on the ink ejection area 511A side on the liquid ejection surface 51A, while contacting with the liquid ejection surface 51A. In this way, the wiper blade 742 performs the wiping operation of wiping off droplets attached to the liquid ejection surface 51A of the line head 51.

The waste liquid tray 75A is disposed to face the liquid ejection surface 51A of the line head 51 on the lower side of the wiper blade 742, i.e. on the lower side of the blade unit 74, in the state where the wipe unit 73 is positioned just below the line head 51 of the image forming portion 50. The waste liquid tray 75A constitutes a part of a waste liquid passage forming portion 75 that forms a waste liquid passage through which the liquid dropping along the wiper blade 742 flows when the wiper blade 742 performs the wiping operation. A structure of this waste liquid tray 75A is described with reference to FIGS. 12 to 15.

Figure 12:
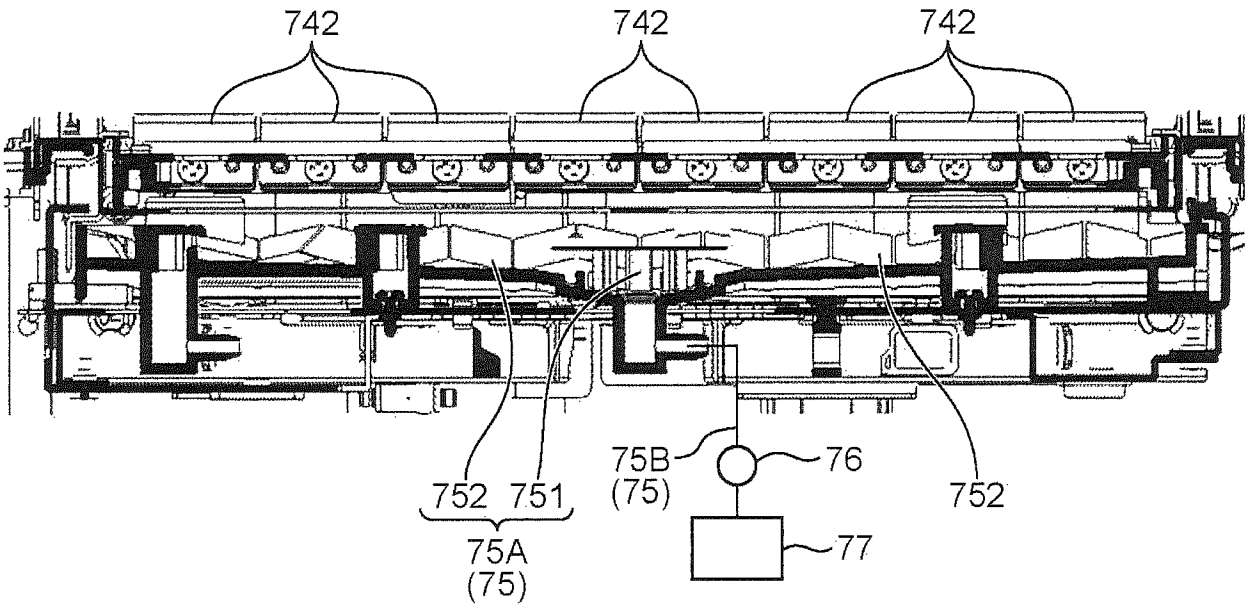
FIG. 12 is a cross-sectional view of the wipe unit.

The waste liquid tray 75A includes a discharge portion 751 and a liquid receiving surface 752. The discharge portion 751 is disposed in a substantially middle portion of the waste liquid tray 75A so as to discharge the liquid (waste liquid) flowing along the liquid receiving surface 752. The liquid discharged from the discharge portion 751 flows in a waste liquid tube 75B (FIG. 12), which is connected to the discharge portion 751 and constitutes a part of the waste liquid passage forming portion 75, and then is collected into a collection tank 77 (FIG. 12). Note that a waste liquid collection pump 76 (FIG. 12) is disposed in the waste liquid tube 75B between the discharge portion 751 of the waste liquid tray 75A and the collection tank 77. When the waste liquid collection pump 76 operates, the liquid discharged from the discharge portion 751 can be efficiently collected into the collection tank 77.

Figure 14:
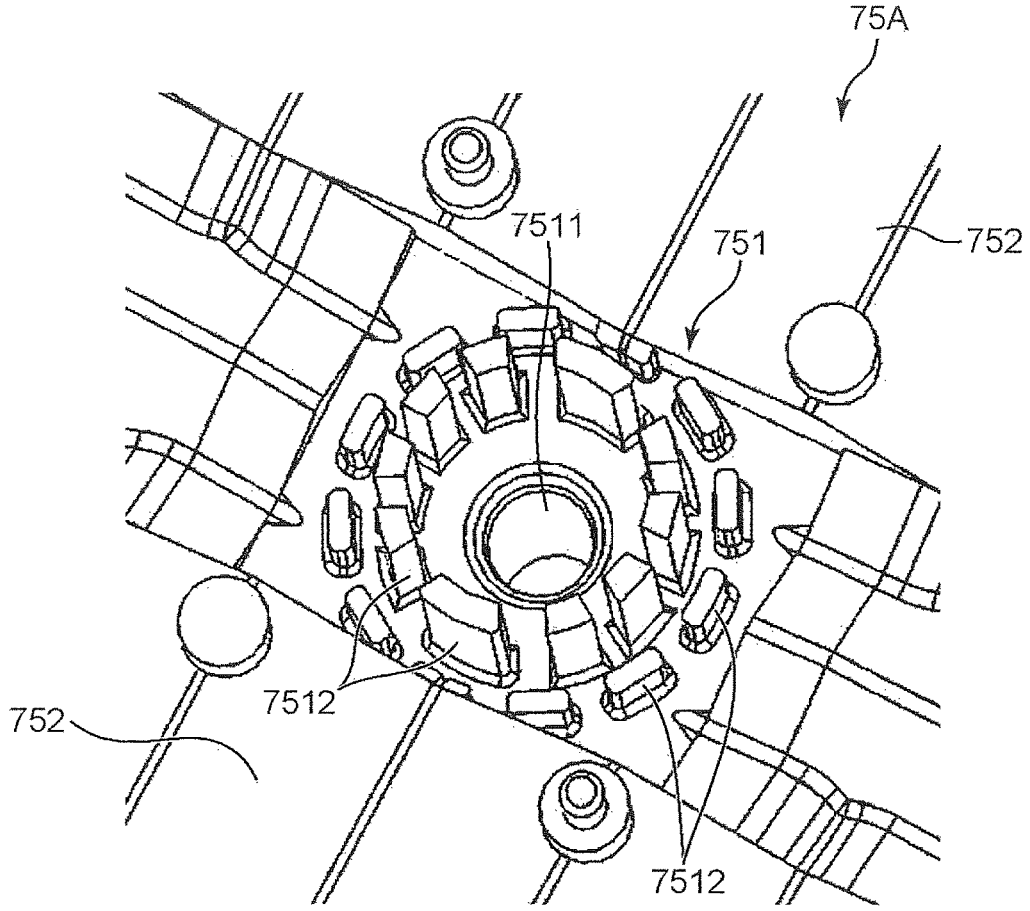
FIG. 14 is an enlarged perspective view of a discharge portion and its vicinity of the waste liquid tray.
Figure 15:
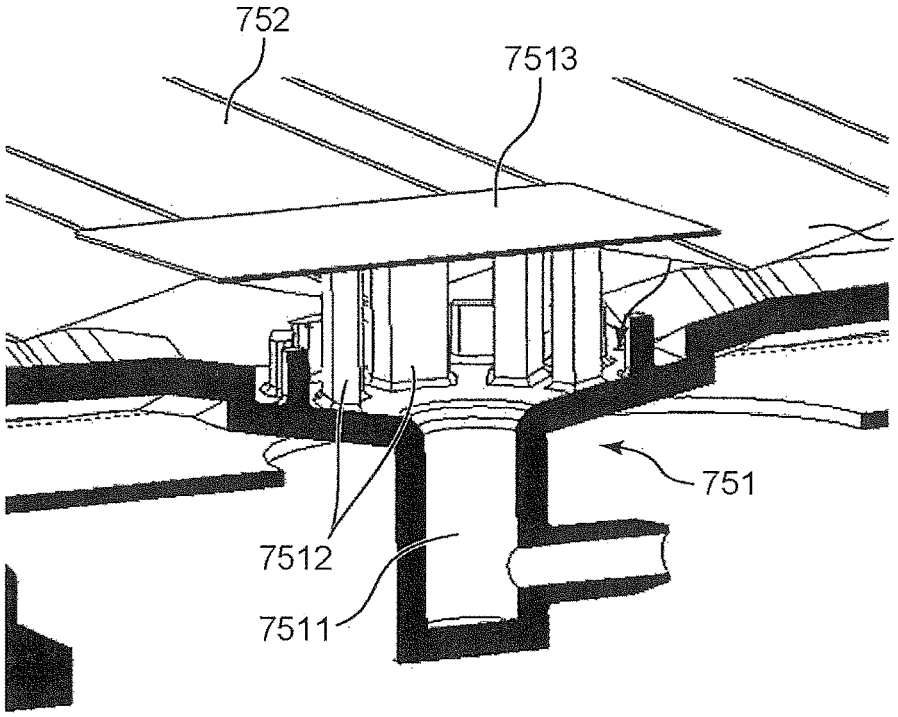
FIG. 15 is an enlarged cross-sectional perspective view of the discharge portion and its vicinity of the waste liquid tray.

As illustrated in FIGS. 14 and 15, the discharge portion 751 includes a discharge port 7511 through which the liquid is discharged, a plurality of ribs 7512 disposed to stand around the discharge port 7511 with predetermined spaces, and a plate-like lid 7513 placed on the ribs 7512. The liquid flowing along the liquid receiving surface 752 to reach the discharge portion 751 passes through spaces between the ribs 7512 and is discharged from the discharge port 7511 to the collection tank 77. Note that the lid 7513 prevents foreign objects such as paper powder from entering the discharge port 7511.

Figure 13:
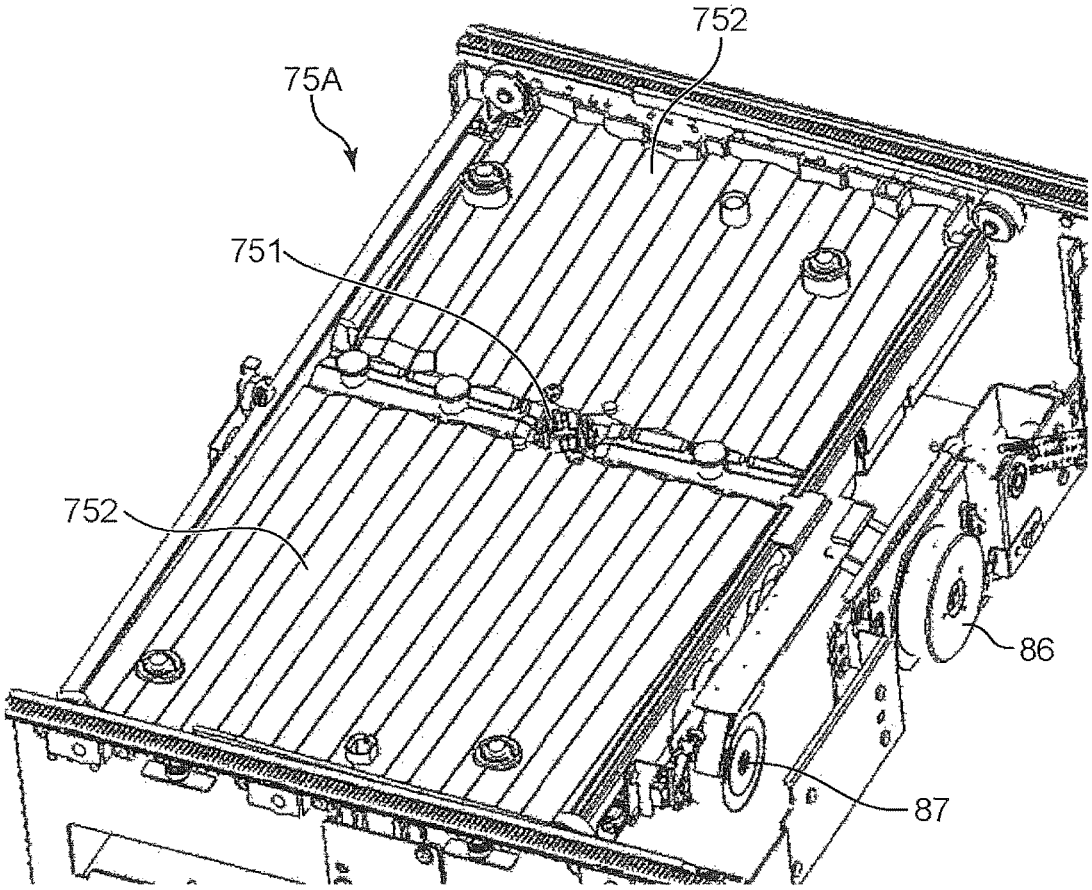
FIG. 13 is a perspective view illustrating a structure of a waste liquid tray of the wipe unit.

The liquid receiving surface 752 of the waste liquid tray 75A is a part forming the waste liquid passage and receives the liquid dropping along the wiper blade 742 when the wiper blade 742 performs the wiping operation. In this embodiment, as illustrated in FIG. 13, the liquid receiving surface 752 is disposed on each side of the discharge portion 751 in the X direction, and each of the liquid receiving surfaces 752 is an inclined surface having a gradient declining toward the discharge portion 751. Note that the liquid receiving surface 752 disposed on the −X side is an inclined surface, inclined upward in the direction from the first end edge 51AA on the cleaning liquid ejection area 512A side to the second end edge 51AB on the ink ejection area 511A side, on the liquid ejection surface 51A of the line head 51 disposed totally on the −X side of the discharge portion 751 in the X direction. The liquid receiving surface 752 disposed on the +X side is an inclined surface, inclined downward in the direction from the first end edge 51AA on the cleaning liquid ejection area 512A side to the second end edge 51AB on the ink ejection area 511A side, on the liquid ejection surface 51A of the line head 51 disposed totally on the +X side of the discharge portion 751 in the X direction. The liquid dropping along the wiper blade 742 when the wiper blade 742 performs the wiping operation flows along the inclination of the liquid receiving surface 752 to the discharge portion 751, and is discharged from the discharge port 7511 of the discharge portion 751 to the collection tank 77.

In the conventional technique, the ink wiped off from the ink ejection surface of the line head by the wiper blade drops along the wiper blade, flows in the waste liquid passage, and is collected into the collection tank. As time elapses, the ink in the waste liquid passage is dried so that its viscosity is increased while its fluidity is decreased, and may abide in the waste liquid passage, causing clogging of the waste liquid passage. Therefore, in the present disclosure, first and second maintenance processes are performed as follows.

The maintenance process including the purging process and the wiping process performed by the maintenance control portion 92 is described in detail with reference to FIGS. 16A, 16B, 16C, 17A, 17B, and 17C. The maintenance control portion 92 performs the first maintenance process shown in FIGS. 16A, 16B, and 16C and the second maintenance process shown in FIGS. 17A, 17B, and 17C, as the maintenance process of the line head 51 including the purging process and the wiping process.

In the first maintenance process, the maintenance control portion 92 controls the purging mechanism 80 to eject cleaning liquid from the cleaning liquid ejection nozzle 512 without ejecting ink from the ink ejection nozzle 511. In this way, cleaning liquid droplets D1 are attached to the cleaning liquid ejection area 512A on the liquid ejection surface 51A of the line head 51 (see FIG. 16A). After that, the maintenance control portion 92 controls the blade moving mechanism 87 to move the blade unit 74 in the X direction, so that the wiper blade 742 moves from the first end edge 51AA on the cleaning liquid ejection area 512A side to the second end edge 51AB on the ink ejection area 511A side on the liquid ejection surface 51A of the line head 51 (see FIGS. 16B and 16C). In this way, the cleaning liquid droplets D1 attached to the liquid ejection surface 51A of the line head 51 are wiped off by the wiper blade 742, and the cleaning liquid drops along the wiper blade 742 toward the liquid receiving surface 752 of the waste liquid tray 75A (see FIG. 16C).

In other words, the first maintenance process includes the cleaning liquid purging operation in which the cleaning liquid is ejected from the cleaning liquid ejection nozzle 512, and the cleaning liquid wiping operation in which the wiper blade 742 wipes off the cleaning liquid droplets D1 the attached to the liquid ejection surface 51A of the line head 51 in the cleaning liquid purging operation.

In the second maintenance process to be performed after the first maintenance process, the maintenance control portion 92 controls the purging mechanism 80 to eject ink from the ink ejection nozzle 511 and to eject the cleaning liquid from the cleaning liquid ejection nozzle 512. In this way, ink droplets D2 are attached to the ink ejection area 511A on the liquid ejection surface 51A of the line head 51, and the cleaning liquid droplets D1 are attached to the cleaning liquid ejection area 512A on the same (see FIG. 17A). After that, the maintenance control portion 92 controls the blade moving mechanism 87 to move the blade unit 74 in the X direction, so that the wiper blade 742 moves from the first end edge 51AA on the cleaning liquid ejection area 512A side to the second end edge 51AB on the ink ejection area 511A side on the liquid ejection surface 51A of the line head 51 (see FIGS. 17B and 17C). In this way, the ink droplets D2 attached to the liquid ejection surface 51A of the line head 51 are wiped off together with the cleaning liquid droplets D1 by the wiper blade 742, and mixed liquid D3 of the ink and the cleaning liquid drops along the wiper blade 742 to the liquid receiving surface 752 of the waste liquid tray 75A (see FIGS. 17B and 17C).

In other words, the second maintenance process includes the cleaning liquid purging operation in which cleaning liquid is ejected from the cleaning liquid ejection nozzle 512, the ink purging operation in which ink is ejected from the ink ejection nozzle 511, and the ink wiping operation in which the wiper blade 742 wipes off the ink attached to the liquid ejection surface 51A of the line head 51 together with the cleaning liquid.

In the first maintenance process performed before the second maintenance process including the ink purging operation, the cleaning liquid purging operation is performed to purge only the cleaning liquid, and then the cleaning liquid wiping operation is performed to wipe off the cleaning liquid droplets D1 from the liquid ejection surface 51A of the line head 51. Therefore, the cleaning liquid dropping along the wiper blade 742 flows on the liquid receiving surface 752 of the waste liquid tray 75A. In this way, before ink flows on the liquid receiving surface 752 in the ink wiping operation after the ink purging operation of the second maintenance process, and before the ink flows in the waste liquid tube 75B, it is possible that the cleaning liquid is attached to the liquid receiving surface 752 and the waste liquid tube 75B constituting the waste liquid passage.

By attaching the cleaning liquid to the liquid receiving surface 752 of the waste liquid tray 75A and the waste liquid tube 75B, there is the cleaning liquid between the ink and the liquid receiving surface 752 as well as the waste liquid tube 75B when the ink flows on the liquid receiving surface 752 and in the waste liquid tube 75B in the second maintenance process. In this way, surface tension of the ink with respect to the liquid receiving surface 752 and the waste liquid tube 75B can be reduced. Therefore, even if the ink flowing on the liquid receiving surface 752 and in the waste liquid tube 75B is dried to have larger viscosity as time elapses, a decrease in fluidity of the ink on the liquid receiving surface 752 and in the waste liquid tube 75B can be suppressed, and it is possible to prevent the ink from abiding on the liquid receiving surface 752 and in the waste liquid tube 75B resulting in clogging of the waste liquid passage, as much as possible.

In addition, in the ink wiping operation in the second maintenance process, the ink attached to the liquid ejection surface 51A of the line head 51 is wiped off together with the cleaning liquid by the wiper blade 742. In this case, the wiper blade 742 moves from the cleaning liquid ejection area 512A to the ink ejection area 511A on the liquid ejection surface 51A of the line head 51. In this way, in the ink wiping operation in the second maintenance process, the cleaning liquid can be attached to the wiper blade 742 before the wiper blade 742 wipes off the ink. Therefore, when the wiper blade 742 wipes off the ink while moving in contact with the liquid ejection surface 51A, friction generated between the wiper blade 742 and the liquid ejection surface 51A is reduced, so that the ink can be wiped off smoothly.

In addition, in this embodiment, the clock portion 93 of the control unit 90 (FIG. 4) measures elapsed time from execution of the first and second maintenance processes by the maintenance control portion 92 every time when the processes are performed. Further, in the first maintenance process, the maintenance control portion 92 sets an ejection amount of the cleaning liquid to be ejected from the cleaning liquid ejection nozzle 512 to a predetermined value, and sets the number of execution times of the first maintenance process for one execution of the second maintenance process in accordance with the elapsed time measured by the clock portion 93.

In accordance with the elapsed time measured by the clock portion 93, i.e. the elapsed time from the last execution of the first and second maintenance processes, drying situation of ink remaining on the liquid receiving surface 752 of the waste liquid tray 75A (waste liquid passage) changes. In this way, when the drying situation of the ink remaining on the liquid receiving surface 752 of the waste liquid tray 75A changes in accordance with the elapsed time measured by the clock portion 93, removability of remaining ink by the cleaning liquid changes. For instance, when the elapsed time measured by the clock portion 93 increases, drying of the remaining ink on the liquid receiving surface 752 of the waste liquid tray 75A is advanced, and finally the ink is fixed to the liquid receiving surface 752. In other words, as the elapsed time measured by the clock portion 93 becomes longer, the remaining ink on the liquid receiving surface 752 of the waste liquid tray 75A is dried more so that removability by the cleaning liquid becomes worse. Therefore, more cleaning liquid is necessary to remove the ink dried and fixed to the liquid receiving surface 752 of the waste liquid tray 75A using the cleaning liquid dropping along the wiper blade 742 in the cleaning liquid wiping operation of the first maintenance process.

If the cleaning liquid ejection amount from the cleaning liquid ejection nozzle 512 in the cleaning liquid purging operation is set to a value more than the predetermined value so as to increase the amount of the cleaning liquid dropping along the wiper blade 742 in the cleaning liquid wiping operation of one time in the first maintenance process, the amount of the cleaning liquid attaching to the wiper blade 742 in the cleaning liquid wiping operation becomes too large. In other words, weight of the cleaning liquid attaching to the wiper blade 742 becomes too large. In this case, the cleaning liquid may drop along the wiper blade 742 despite of drop restraint based on surface tension of the cleaning liquid with respect to the wiper blade 742, on the way for the wiper blade 742 to move from the first end edge 51AA on the cleaning liquid ejection area 512A side to the second end edge 51AB on the ink ejection area 511A side on the liquid ejection surface 51A of the line head 51 in the cleaning liquid wiping operation. Then, the cleaning liquid is not supplied to an upper side end and its vicinity in the inclination direction in a part of the liquid receiving surface 752 of the waste liquid tray 75A. Therefore, the remaining ink on the liquid receiving surface 752 of the waste liquid tray 75A cannot be effectively removed.

Therefore, in the first maintenance process, the maintenance control portion 92 sets the ejection amount of the cleaning liquid to be ejected from the cleaning liquid ejection nozzle 512 to a predetermined value and sets the number of execution times of the first maintenance process in accordance with the elapsed time measured by the clock portion 93. For instance, the maintenance control portion 92 sets the number of execution times of the first maintenance process to a larger value as the elapsed time measured by the clock portion 93 is longer. In this way, dropping of the cleaning liquid on the way for the wiper blade 742 to move in the cleaning liquid wiping operation is prevented, and the supply amount of the cleaning liquid to the liquid receiving surface 752 of the waste liquid tray 75A can be adjusted by setting the number of execution times of the first maintenance process. Therefore, remaining ink on the liquid receiving surface 752 of the waste liquid tray 75A can be effectively removed.

Figure 16A:
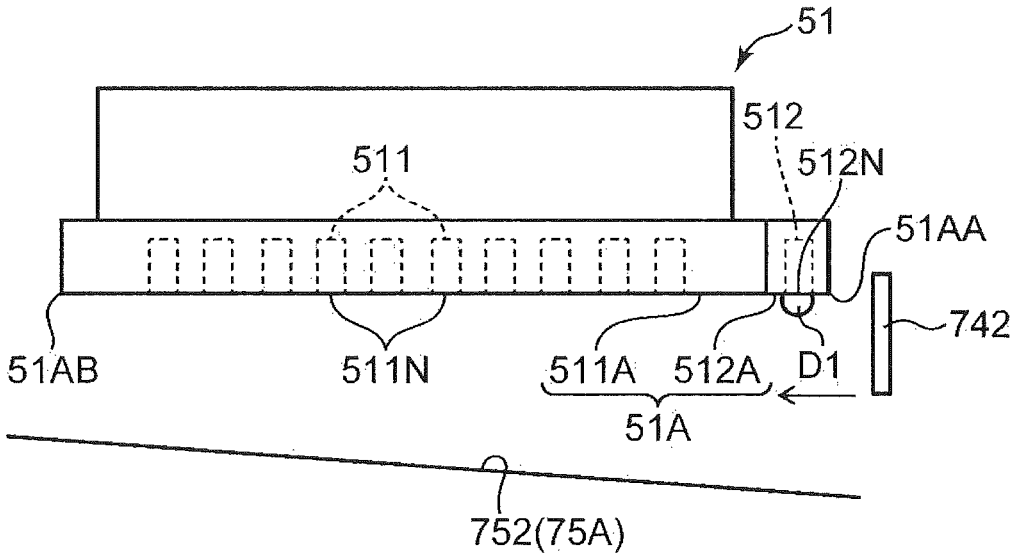
FIGS. 16A, 16B, and 16C are diagrams for explaining a first maintenance process performed by the maintenance control portion.
Figure 16B:
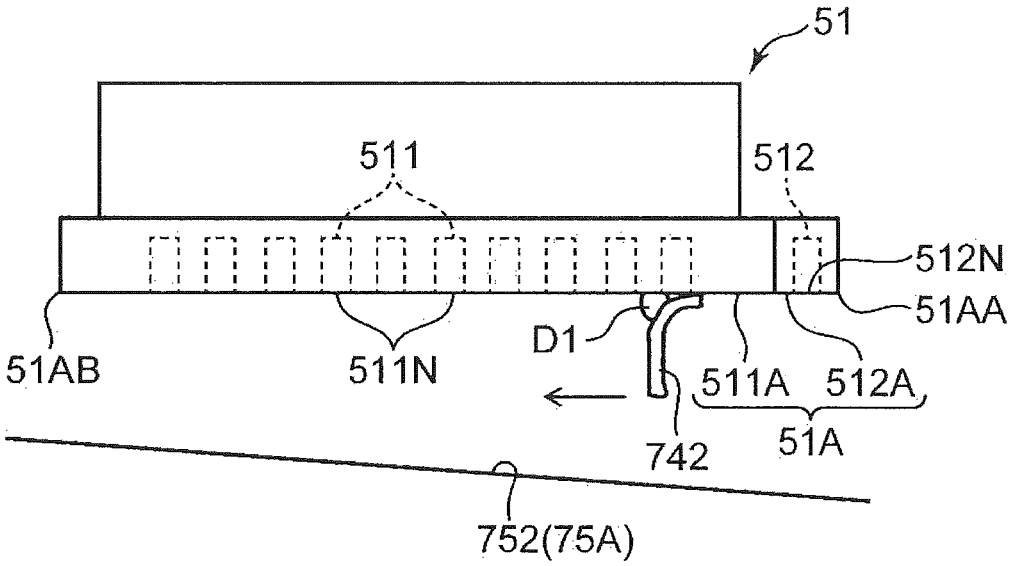
Figure 16C:
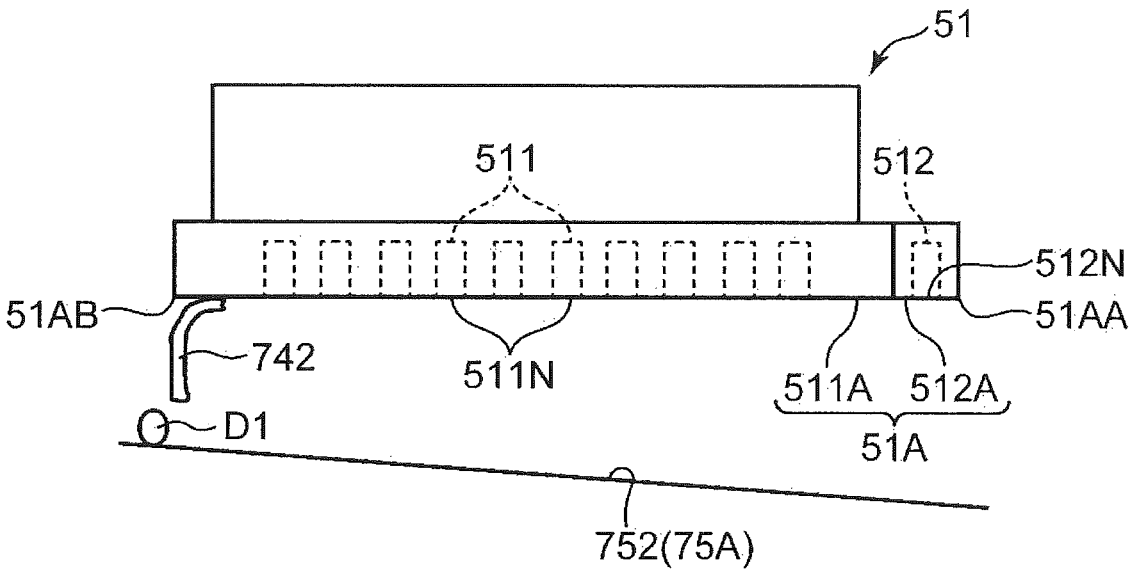
Figure 17A:
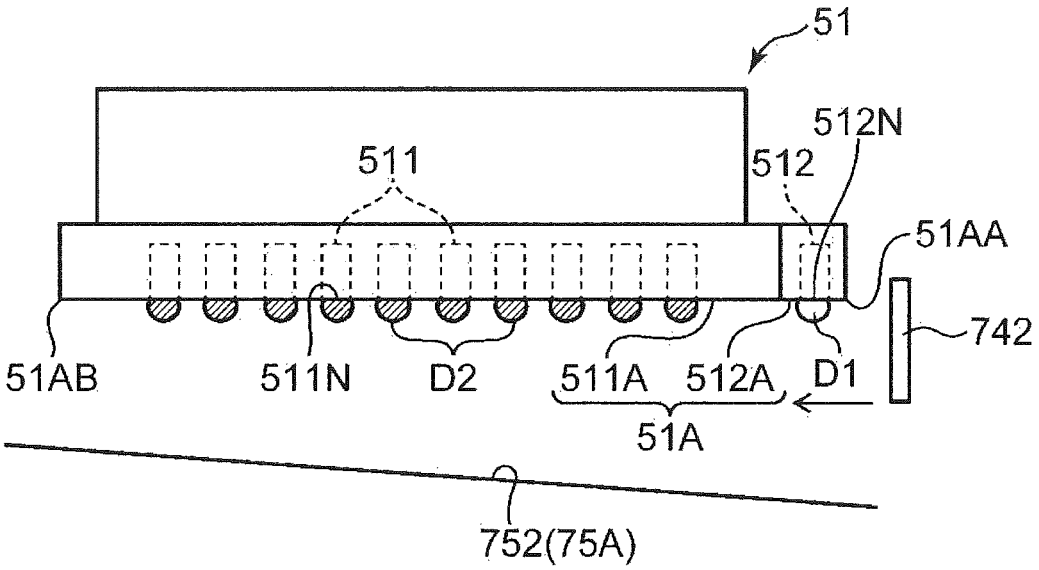
FIGS. 17A, 17B, and 17C are diagrams for explaining a second maintenance process performed by the maintenance control portion.
Figure 17B:
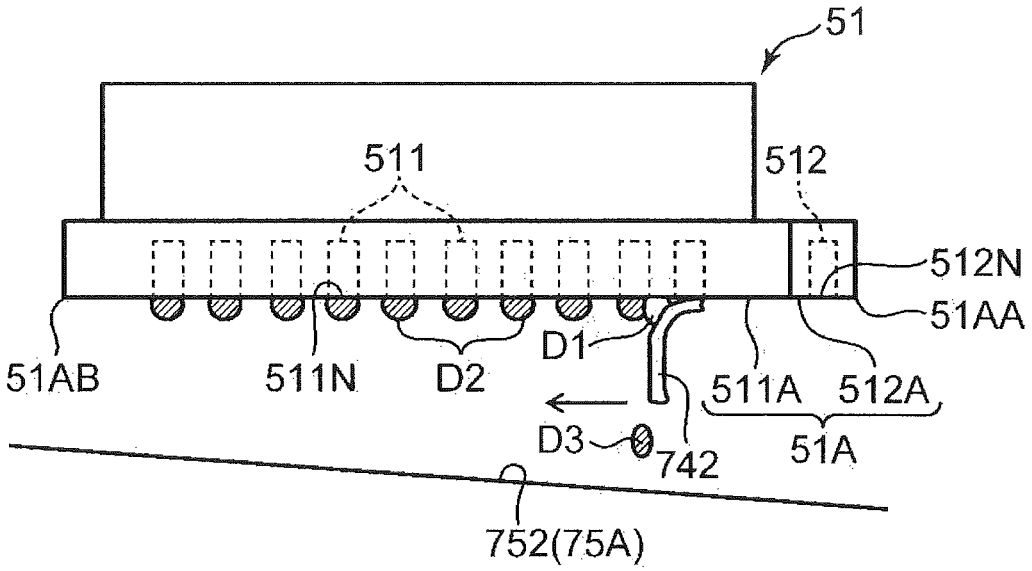
Figure 17C:
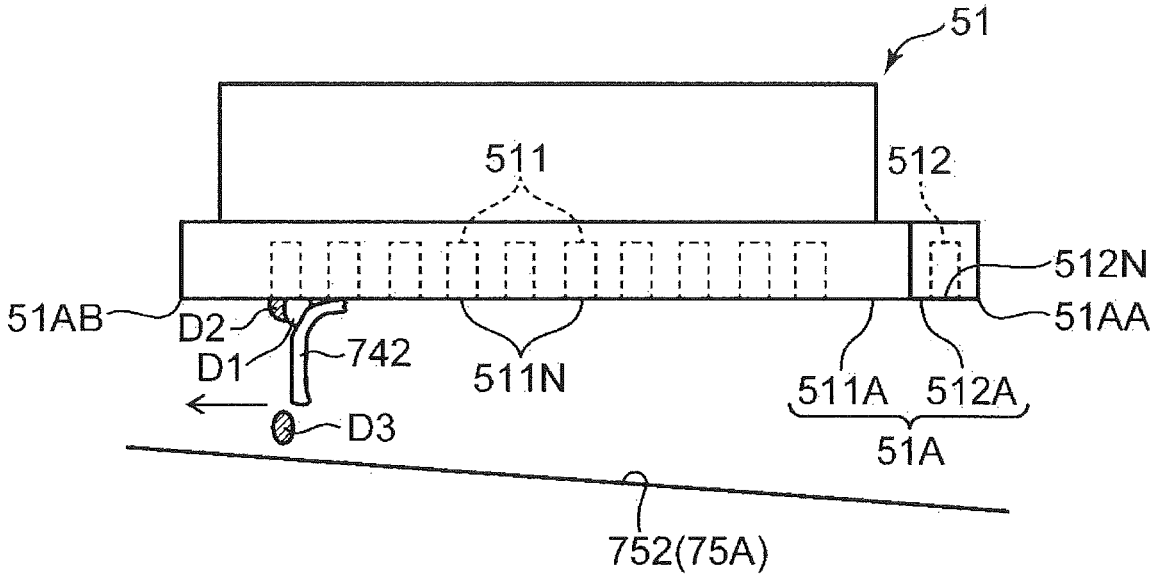

In addition, in the first maintenance process, the maintenance control portion 92 controls the wiper blade 742 to move from the first end edge 51AA to the second end edge 51AB on the liquid ejection surface 51A of the line head 51 and to stop for a predetermined time (e.g. a few seconds) when reaching the second end edge 51AB (see FIG. 16C). In other words, in the cleaning liquid wiping operation in the first maintenance process, the wiper blade 742 moves from the first end edge 51AA to the second end edge 51AB on the liquid ejection surface 51A of the line head 51 and stops for a predetermined time when reaching the second end edge 51AB. During the stop of the wiper blade 742 for predetermined time at the second end edge 51AB on the liquid ejection surface 51A, the cleaning liquid drops along the wiper blade 742, so that the cleaning liquid can be supplied to the upper side end and its vicinity in the inclination direction in a part of the liquid receiving surface 752 of the waste liquid tray 75A.

What is claimed is:

1. An ink jet recording apparatus comprising:

a line head including a plurality of ink ejection nozzles to eject ink arranged in a predetermined direction, and a cleaning liquid ejection nozzle to eject cleaning liquid disposed at one side in the predetermined direction, the line head having a liquid ejection surface including an ink ejection area formed by nozzle holes of the ink ejection nozzles and a cleaning liquid ejection area formed by a nozzle hole of the cleaning liquid ejection nozzle;

a purging mechanism arranged to perform an ink purging operation to eject pressured ink from the ink ejection nozzles and a cleaning liquid purging operation to eject pressured cleaning liquid from the cleaning liquid ejection nozzle;

a wiper blade arranged to move from a first end edge on the cleaning liquid ejection area side to a second end edge on the ink ejection area side on the liquid ejection surface while contacting with the liquid ejection surface so as to wipe off droplets attached to the liquid ejection surface;

a blade moving mechanism arranged to allow the wiper blade to move;

a waste liquid passage forming portion arranged to form a waste liquid passage allowing liquid wiped off by the wiper blade from the liquid ejection surface to flow, and a maintenance control portion arranged to control the purging mechanism and the blade moving mechanism to perform a maintenance process of the line head, wherein the maintenance control portion performs a first maintenance process of allowing the cleaning liquid ejection nozzle to eject the cleaning liquid without allowing the ink ejection nozzles to eject ink, and then allowing the wiper blade to move from the first end edge to the second end edge on the liquid ejection surface, and a second maintenance process of allowing the ink ejection nozzles to eject ink while allowing the cleaning liquid ejection nozzle to eject the cleaning liquid, and then allowing the wiper blade to move from the first end edge to the second end edge on the liquid ejection surface, after the first maintenance process.

2. The ink jet recording apparatus according to claim 1, wherein the waste liquid passage forming portion includes a waste liquid tray disposed to face the liquid ejection surface on the lower side of the wiper blade, and has a liquid receiving surface to receive liquid dropping along the wiper blade, and the liquid receiving surface is an inclined surface inclined upward in a direction from the first end edge to the second end edge of the liquid ejection surface.

3. The ink jet recording apparatus according to claim 2, further comprising a clock portion arranged to measure elapsed time from execution of the maintenance process by the maintenance control portion every time when the maintenance process is performed, wherein in the first maintenance process, the maintenance control portion sets an ejection amount of the cleaning liquid to be ejected from the cleaning liquid ejection nozzle to a predetermined value, and sets the number of execution times of the first maintenance process for one execution of the second maintenance process in accordance with the elapsed time measured by the clock portion.

4. The ink jet recording apparatus according to claim 2, wherein in the first maintenance process, the maintenance control portion controls the wiper blade to move from the first end edge to the second end edge on the liquid ejection surface and to stop for a predetermined time when reaching the second end edge.

5. The ink jet recording apparatus according to claim 3, wherein in the first maintenance process, the maintenance control portion controls the wiper blade to move from the first end edge to the second end edge on the liquid ejection surface and to stop for a predetermined time when reaching the second end edge.

6. The ink jet recording apparatus according to claim 1, further comprising a clock portion arranged to measure elapsed time from execution of the maintenance process by the maintenance control portion every time when the maintenance process is performed, wherein in the first maintenance process, the maintenance control portion sets an ejection amount of the cleaning liquid to be ejected from the cleaning liquid ejection nozzle to a predetermined value, and sets the number of execution times of the first maintenance process for one execution of the second maintenance process in accordance with the elapsed time measured by the clock portion.

7. The ink jet recording apparatus according to claim 6, wherein in the first maintenance process, the maintenance control portion controls the wiper blade to move from the first end edge to the second end edge on the liquid ejection surface and to stop for a predetermined time when reaching the second end edge.

8. The ink jet recording apparatus according to claim 1, wherein in the first maintenance process, the maintenance control portion controls the wiper blade to move from the first end edge to the second end edge on the liquid ejection surface and to stop for a predetermined time when reaching the second end edge.

* * * * *